US006578323B1

(12) United States Patent
Zartman et al.

(10) Patent No.: US 6,578,323 B1
(45) Date of Patent: Jun. 17, 2003

(54) COLUMBARIUM AND NICHE UNIT THEREFOR

(76) Inventors: Ronald Richard Zartman, P.O. Box 828, Grandville, MI (US) 49468-0828; Donald F. Morgan, 2574 Meadow Dr., Zeeland, MI (US) 49464; Russell O Blanchard, 154 S. Church St., Zeeland, MI (US) 49464

( * ) Notice: Subject to any disclaimer, the term of this patent is extended or adjusted under 35 U.S.C. 154(b) by 42 days.

(21) Appl. No.: 09/665,548

(22) Filed: Sep. 19, 2000

(51) Int. Cl.[7] ..... E04H 13/00

(52) U.S. Cl. ..... 52/134; 52/79.1; 52/129; 52/140; 52/136; 27/1; 27/11

(58) Field of Search ..... 52/79.1, 128, 129, 52/134, 135, 136, 137, 139, 140; 27/1, 2, 11, 35

(56) References Cited

U.S. PATENT DOCUMENTS

| | | | | | |
|---|---|---|---|---|---|
| 370,276 | A | * | 9/1887 | Mooney | 52/139 |
| 1,453,375 | A | * | 5/1923 | Allen | 52/134 |
| 1,964,234 | A | * | 6/1934 | Vogel | 52/141 |
| 3,183,574 | A | * | 5/1965 | Diem | 27/1 |
| 3,529,730 | A | * | 9/1970 | Thompson | 27/1 X |
| 3,888,055 | A | * | 6/1975 | Gallo | 52/98 |
| 3,981,054 | A | * | 9/1976 | Hull et al. | 27/17 |
| 4,607,417 | A | * | 8/1986 | Hancovsky | 27/1 |
| 4,614,066 | A | * | 9/1986 | Koppenberg | 52/134 |
| 4,862,655 | A | * | 9/1989 | LePage et al. | 52/131 |
| 4,924,565 | A | * | 5/1990 | Rathjen | 27/11 |
| 5,010,697 | A | * | 4/1991 | Schwarten | 27/35 |
| RE33,636 | E | * | 7/1991 | Yearsley | 27/35 |
| 5,195,812 | A | * | 3/1993 | Eickhof | 52/136 X |
| 5,287,603 | A | * | 2/1994 | Schorman | 27/1 |
| 5,408,787 | A | * | 4/1995 | Barnett | 27/6 |
| 5,659,932 | A | * | 8/1997 | Wright | 27/17 |
| 5,740,637 | A | * | 4/1998 | Snow | 52/136 |
| 5,881,505 | A | * | 3/1999 | Larkin, III et al. | 52/136 |
| 5,979,124 | A | * | 11/1999 | Branan | 52/136 |
| 6,052,954 | A | * | 4/2000 | Dudek et al. | 27/7 |
| 6,167,600 | B1 | * | 1/2001 | Williams et al. | 27/1 |
| 6,170,201 | B1 | * | 1/2001 | Mason et al. | 27/35 |

FOREIGN PATENT DOCUMENTS

| | | | | |
|---|---|---|---|---|
| FR | 2765476 A1 | * | 8/1999 | A61G/17/00 |

* cited by examiner

*Primary Examiner*—Carl D. Friedman
*Assistant Examiner*—Brian E. Glessner
(74) *Attorney, Agent, or Firm*—James G. Staples

(57) ABSTRACT

A columbarium suitable for indoor or outdoor placement includes a plurality of niche units carried by a supporting framework, the niche units being independently assembleable and disassembleable from the supporting framework as often as desired prior to activation but, upon activation, being permanently connected to the framework, each niche unit having means for creating a non-air atmosphere within the niche unit upon activation of the niche unit, each niche unit having four seals protecting the niche unit interior.

26 Claims, 7 Drawing Sheets

COLUMBARIUM AND NICHE UNIT THEREFOR

This invention pertains generally to interment structures and more specifically to a columbarium consisting of a support structure and one, or more frequently a plurality, of niche units received in the support structure.

BACKGROUND OF THE INVENTION

There has been an increase in demand for use of columbariums as a method of interment due to a number of factors which have become increasingly relevant in modern society including a definite trend toward cremation and the decreasing space available in existing cemeteries, particularly in urban areas where cemetery space can no longer be expanded. The same space pressure exists in churches of many faiths which have in the past allowed interment within the walls of the sanctuary As with outdoor cemetery interment, a great many sanctuaries cannot be expanded to accommodate further interments and yet the need exists to provide indoor final resting places, particularly in churches which have been long established.

A number of columbarium structures have been proposed, and used, in recent years but nearly all such structures have one or several drawbacks which have prevented any single construction to become the standard. For example, it is always desired that the final appearance be dignified and impressive, and this requirement is most often met by the use of a face plate, often made of marble or other majestic stone, attached to, but not forming a part of, the box or niche in which the remains are held. A face plate requires the use of exteriorly accessible means for fastening the face plate to the niche, and such exterior fastening means tend to detract from the dignity and mood of reverence with which people view the crypt. If the exterior fastening means are ornate, or simple, they run the risk of going out of fashion with the passage of time. If the exterior fastening means are not perfectly aligned and rigidly maintained, they enormously detract from the aesthetic appearance of the individual niche and the columbarium as a whole. And the use of exterior fastening means is subject to defacement by vandals, particularly in outdoor settings.

One of the most difficult attributes to achieve in an individual niche unit is providing the capability of quickly removing the face plate from the niche unit at the time the niche unit must be opened to receive remains, and then just as easily replacing and then permanently securing the face plate in place.

Many current assemblies, consisting essentially of a box or niche and an associated niche cover, also have drawbacks which have not been fully resolved in an economical manner. As one example, most niche assemblies are so designed that they do not form a sealed space into which a container containing the remains are placed. Rather such niche assemblies usually rely on the surrounding support structure and the face plate to form a receiving space and such an arrangement is very seldom, if ever, effectively sealable. Thus the remains are placed in a sealed container which is placed within the space defined by the niche assembly, and hence only one sealed enclosure protects the remains. Changes in atmospheric pressure and the passage of time can on occasion degrade the sealed container received from the crematorium and thus the remains may eventually be exposed to the degenerating effect of ambient air and, in some localities, the danger of storm water, particularly in outdoor ground level environments.

One or some of the above mentioned drawbacks have been overcome in a few known designs, but no current design eliminates all of the above drawbacks in a single design. Even those constructions which eliminate one or some of the above drawbacks have the further disadvantage that the drawback is only overcome by means which are expensive or difficult to work with, and usually both. U.S. Pat. No. 3,888,055 is an example of a known construction which eliminates aesthetically displeasing exterior fastening means, but it does so only by the use of complex parts, some of which have to be destroyed and replaced when a niche unit is to be activated. Further, it is inherently incapable of providing a double sealed system since clearance must always be provided for severing the connecting pins which hold the face plate in position when the niche unit is to be activated.

SUMMARY OF THE INVENTION

The invention is a columbarium and a niche unit therefor which (1) may be located on either a horizonal or vertical surface indoor or outdoor with no decrease in its functionality, (2) provides a double seal for the interred remains, (3) is substantially unaffected by changes in atmospheric pressures and/or the passage of time so that maximum protection is provided to the remains, (4) is inexpensive, compared to existing inferior constructions at least, (5) is well adapted to being formed in large measure from inexpensive materials such as plastics and standardized structural steel components, (6) contains a minimum of individual parts compared to existing patented constructions, (7) presents an appearance of maximum aesthetic impression both before and after activation, (8) provides reinforced atmospheric sealing by the use of negative pressure and, if desired, a neutral atmosphere, (9) is light weight and mobile, and (10) is easily disassembled and reassembled in the event the need arises at a later date to obtain access to the interior or move the unit to a different location, such as to an upper floor from a lower floor.

Among its significant features are a two piece plastic niche assembly which can be easily held in place by simple hand pressure while awaiting activation and, when activation is required, just as readily reclosed and permanently scaled, and a niche assembly within which a negative pressure can be obtained or a neutral atmosphere created so that the niche assembly is virtually immune to atmospheric conditions. A further feature is a third seal which utilizes the face plate as a component of the third seal thereby utilizing the face plate as a functional element to eliminate the possibility of vermin, such as insects and mice, from gaining access to the interior, as well as an aesthetic feature. Yet a further feature is a simple spring clip means which connects the face plate to the niche assembly in two relationships, the first being a temporary non-sealed multi-activation relationship and the second being a permanent non-activateable rigid sealing relationship.

The foregoing and other functions and advantages not specifically mentioned will become apparent from the following detailed description of the invention.

BRIEF DESCRIPTION OF THE DRAWING

The invention is illustrated more or less diagrammatically in the accompanying drawing in which.

Like reference numerals will be used to refer to like or similar parts from Figure to Figure in the drawing in the following detailed description of the invention.

DETAILED DESCRIPTION

The columbarium of this invention is indicated generally in a fully assembled form at 10. In this instance the columbarium is shown mounted to a vertical surface, here a wall 11, by means which will be described hereafter. It will be understood that the columbarium can be mounted on a horizontal surface, such as an indoor or outdoor concrete base, or a wood base for an indoor location. It will also be understood that the columbarium is shown as it would appear if it is empty, partially filled, or completely full; the eye of the observer cannot detect the degree of utilization of the columbarium. In the event owners of the individual units wish to attach a nameplate to a unit, they may do so assuming it is the policy of the columbarium proprietor to give such permission and, if so, then the observer can deduce that some at least of the units have been used.

In this instance 16 individual units have been shown, two of the units being indicated generally at 12 and 13.

Figure 2:
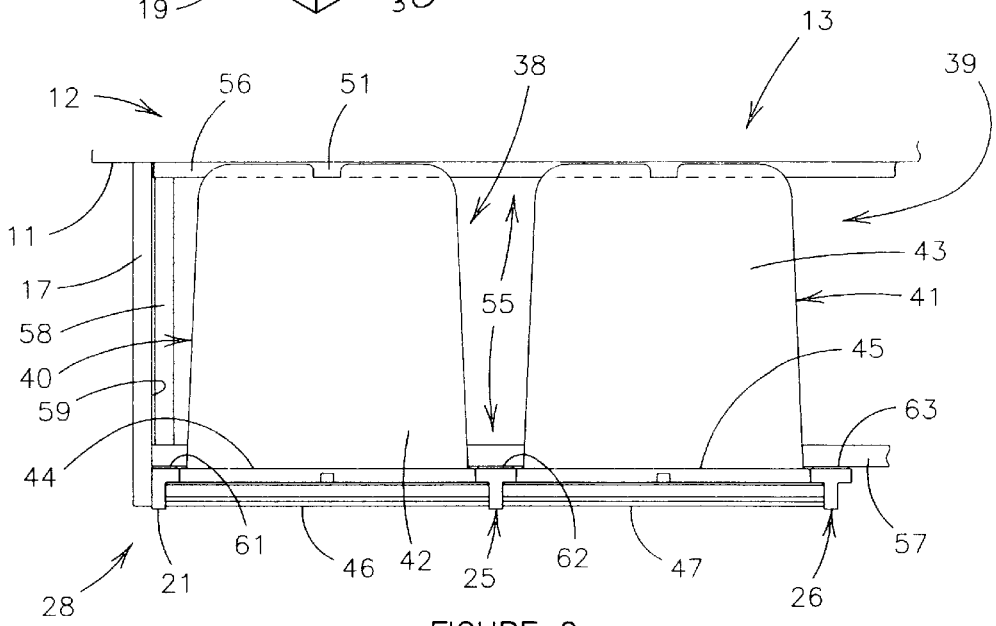
FIG. 2 is a partial cross section through a portion of FIG. 1 showing two left niche units in top plan view.

The exterior housing, which forms part of the support means for the individual units, is indicated generally at 15, the housing including top panel 16, two side panels 17 and 18, and a base 19. The panels and base may be made of any suitable material depending on location. If the columbarium is mounted indoor the panels and/or base may be made of wood or metal, but if mounted outdoor metal or a more weather resistant material, such as concrete, may be used. The exterior edge of top panel 16 is indicated at 20, the exterior or exposed edges of side panels 17 and 18 at 21 and 22 respectively, and the exterior edge of base 19 at 23. Three T-shaped vertical dividers which extend from the base 19 to top panel 16 are indicated generally at 25, 26 and 27, and two L-shaped vertical dividers, see FIG. 2, are indicated generally at 28 and 29. Five series of horizontal dividers are indicated generally at 30, 31, 32, 33 and 34. In this instance the vertical dividers 25–29 extend from the base 23 to the top panel 16 and the individual dividers, such as 35 and 36 in series 32 extend only between their flanking vertical dividers.

Figure 3:
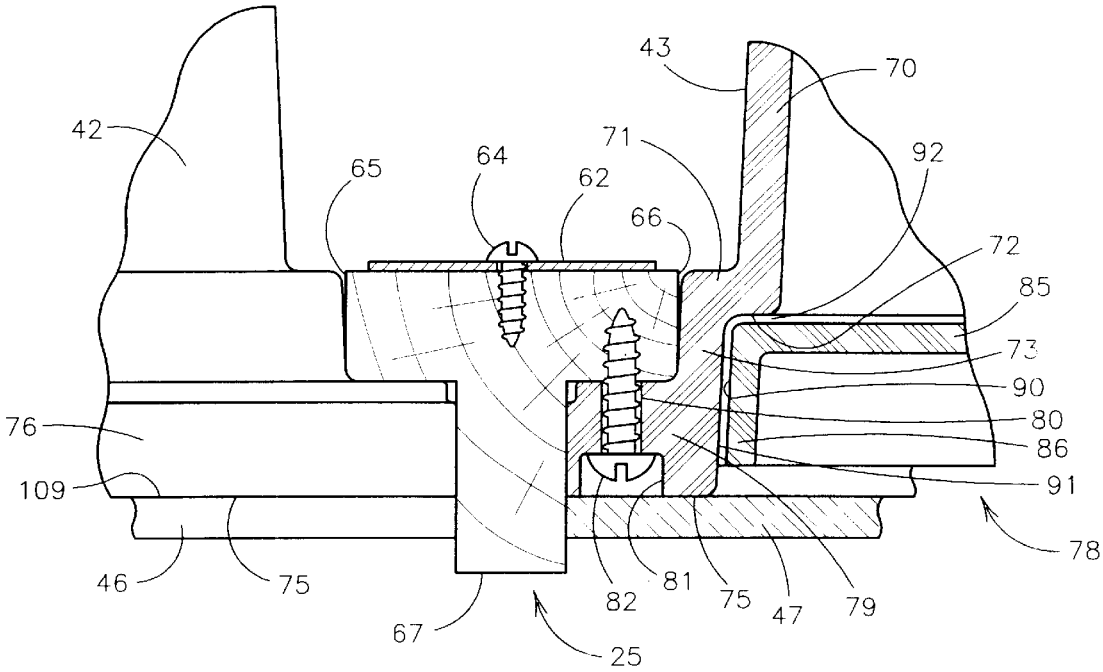
FIG. 3 is a sectional view through the means for mounting the individual units to the supporting structure with the right side broken away for clarity, this Figure showing the niche unit in an activated condition.

Referring now particularly to FIGS. 2 and 3, two adjacent niche units are indicated generally at 38 and 39. Each niche unit includes a niche assembly, indicated generally at 40, 41, each niche assembly consisting of a niche 42, 43 and an associated cover 78. See FIGS. 5 and 6. The niche unit 38 consists of niche assembly 40 and a face plate 46 (see also FIGS. 3, 4 and 14) connected thereto, and by like token niche unit 39 consists of niche assembly 41 and a face plate 47 connected thereto.

Figure 7:
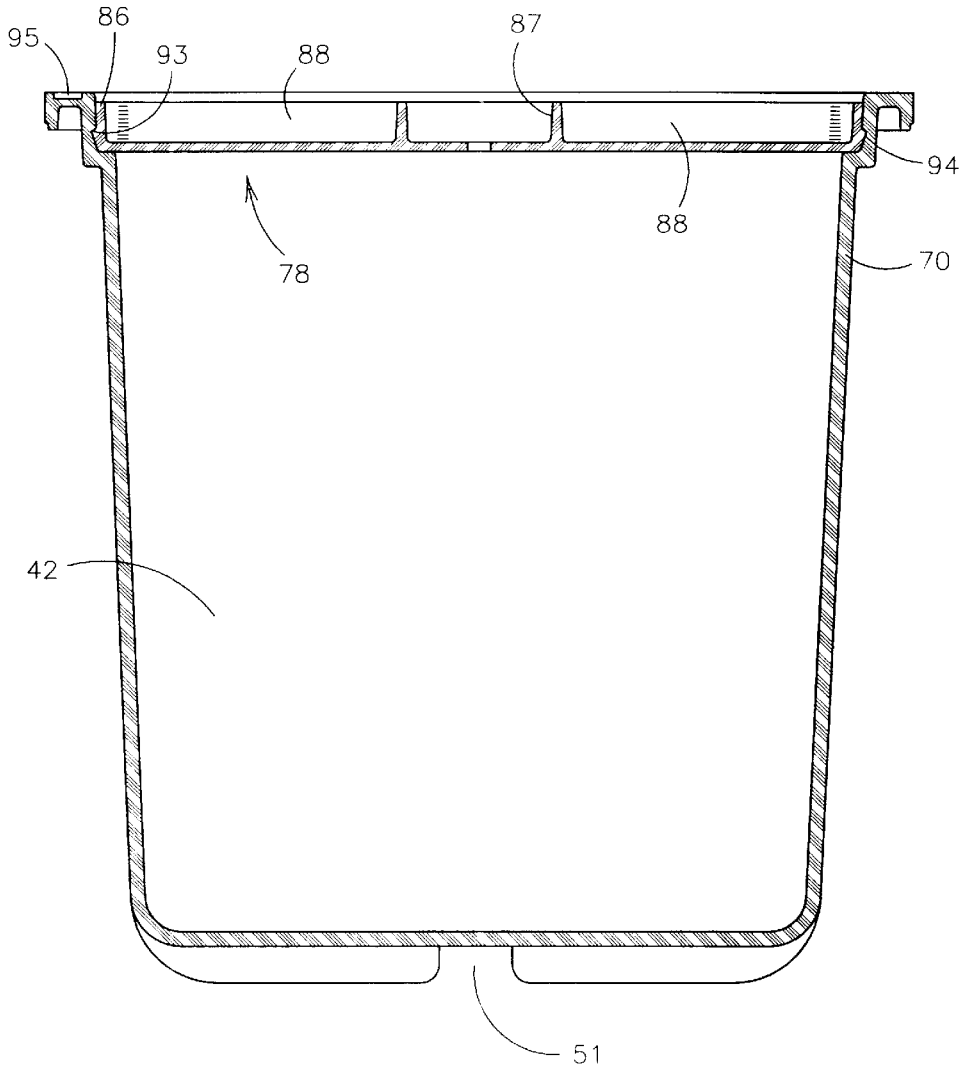
FIG. 7 is a section view taken substantially along the line 7—7 of FIG. 5.
Figure 11:
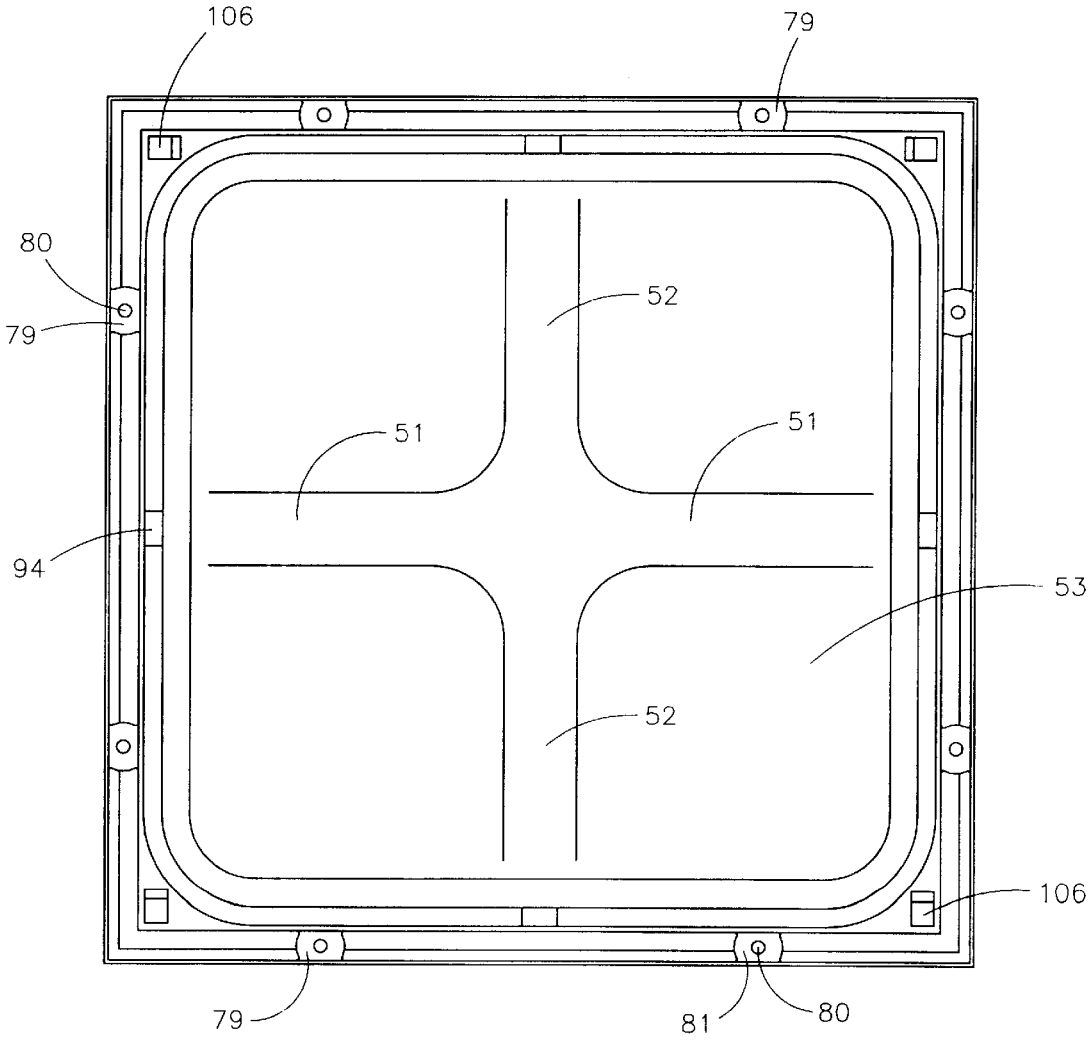
FIG. 11 is a view of the bottom of the box shown in FIG. 5.

Referring now particularly to FIGS. 2, 7 and 11 it will be noted from FIGS. 7 and 11 that niche 42 has two grooves 51 and 52 formed in the bottom 53 thereof, each groove extending to the far edge of the outer plane of bottom 53.

Referring now again to FIG. 2 it will be seen that the support means 55 for the niche units consists of, in this instance, a metal frame composed of standardized metal units, the frame including horizontal rear support channels, one of which is shown at 56 in FIG. 2, and horizontal front support channels, one of which is shown at 57. The front support channel 57 is secured to a horizontal spacer 58, see FIG. 2, at each of its ends. The spacers 58, one of which underlies at least each of the top three horizontal rows of niches, are secured by any suitable means to end structure, indicated at 59, the end structure 59 in turn forming a support structure to which the side panel 17 may be secured.

Figure 1:
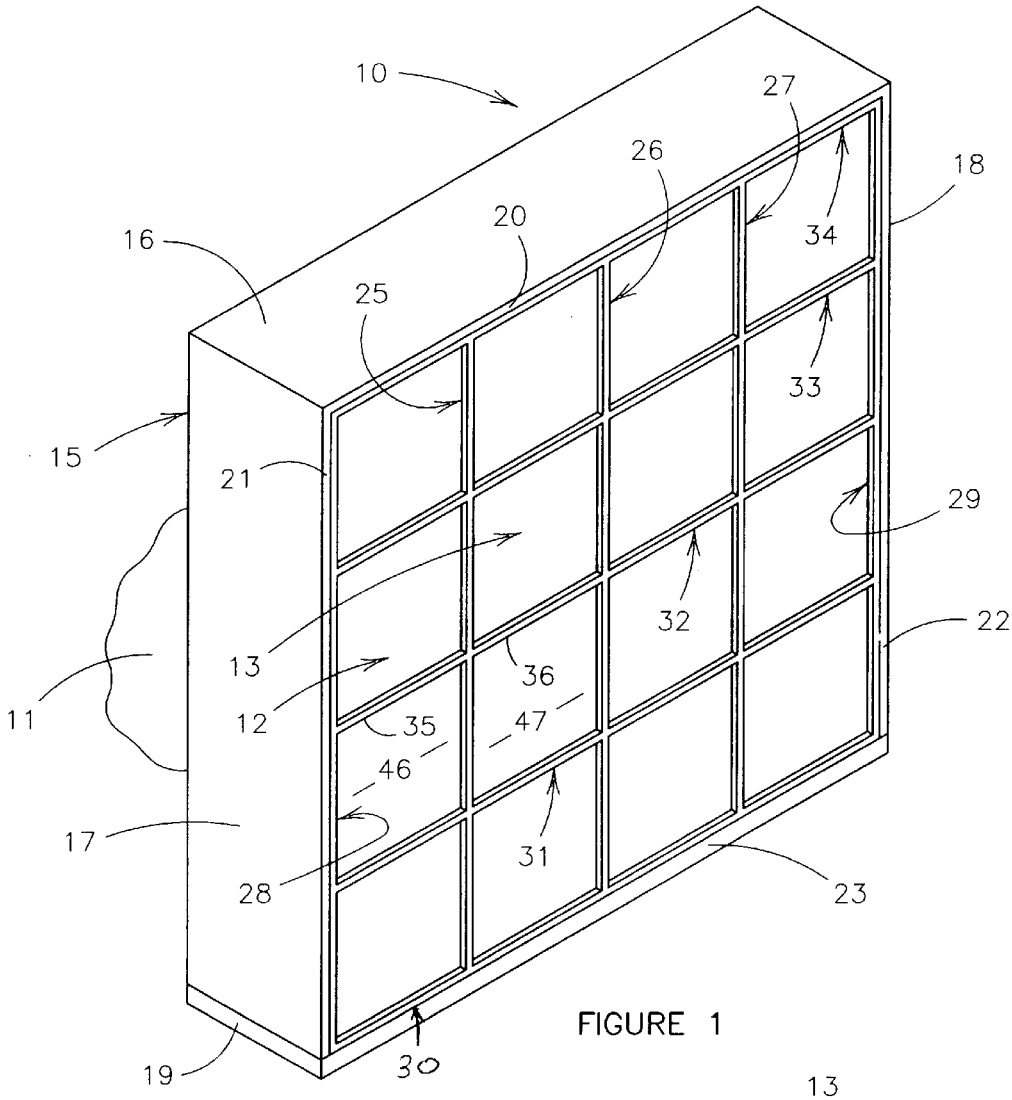
FIG. 1 is a perspective of a 16 unit columbarium attached, in this instance, from a vertical wall surface though it could be used in a free standing condition which, in many locations, would be the preferred condition.

As will be readily seen from (1) the absence of any structure in the space between niches 42 and 43 in FIG. 2, and (2) the rigid spatial positioning of the niches 42, 43 resulting from the seating of the horizontal rear support channel 56 into the grooves 51 in the rear of each niche 42, 43, that only a second end structure 59 at the right end of the columbarium shown in FIG. 1 is required to provide a rigid, self-standing support means 55.

It will be understood that, while the front horizontal support member 57 lies just beneath the open end of niches 42 and 43 to form a rigid base on which the front end portion of the niches can rest, the rear horizontal support channel 56 is at the level of the middle of the niches 42 and 43 in their FIG. 2 position. In this position the support channel 56 mates with the groove 52 in the bottom of the niches 42 and 43, thereby, in cooperation with the front support channel 57, maintaining the niches in a stable, horizontal position.

Referring now particularly to FIGS. 2 and 3 it will be seen that a plurality of flat vertical uprights 61, 62 and 63 extend upwardly from the lower front support channel 57 and are secured at their upper ends to an upper front support channel, not shown. From FIG. 3 which illustrates upright 62 to a larger scale than FIG. 2, it will be seen that the vertical T-divider 25 is connected to the upright 62 by fastener 64. As a consequence the outer edges 65, 66 of the cross bar of the T-divider 25 form abutments which preclude sideways movement of a niche as viewed in FIGS. 2 and 3. As seen in FIG. 3, the undersides of the cross bar of T-divider 25 engage an outwardly projecting portion of the rim portion of niches 42 and 43 to further preclude rearward movement of the niches and prevent front wobble.

It will be noted that T-divider 25 is made of wood so that fastener 64 may be a wood screw. The advantage of using wood is that the exposed end face 67 of the T-divider will present a wood grain surface to the viewer which is aesthetically pleasing in this environment. A T-shaped metal channel could of course be used if desired with minimal modifications.

The niches 42, 43 are illustrated in larger detail in FIGS. 3, 6–8, 10 and 11. From FIGS. 3, 6 and 8 it will be seen that the slightly upwardly and outwardly tapering walls 70 of the niche terminate in an annular flange 71 which has an outwardly facing seating surface 72. An annular collar portion 73 extends further upwardly and outwardly (as best viewed in FIG. 8) and terminates in an upper flange 74 having an upper smooth sealing surface 75. The extremity of flange 74 has a down turned lip 76 which in turn has a circular notch or undercut indicated at 77.

Figure 8:
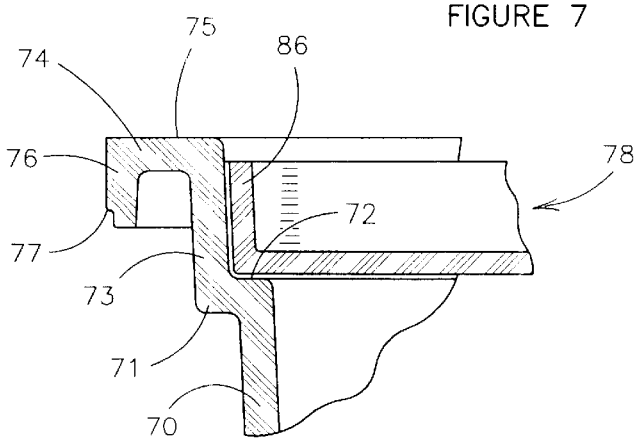
FIG. 8 is a section view taken substantially along the line 8—8 of FIG. 5 to an enlarged scale with the lower portion of the box broken away.

The flange 71 and the outwardly extending collar 73 form seat 72 which receives an associated cover indicated generally at 78 whose features will be described hereinafter, the cover 78 resting on seating 72 and forming, with the niche 42, the niche assembly. It will be noted that, when the niche unit is activated, suitable sealant/adhesive will be present between the seating surface 72 and the aligned portion of the bottom of cover 78, as viewed in FIG. 8, and extending upwardly between the interior wall surface of collar portion 73 and abutting portion of the edge of cover 78. No sealant/adhesive is shown in FIGS. 3 and 8 to indicate a niche assembly in unactivated condition and for ease of description.

Figure 5:
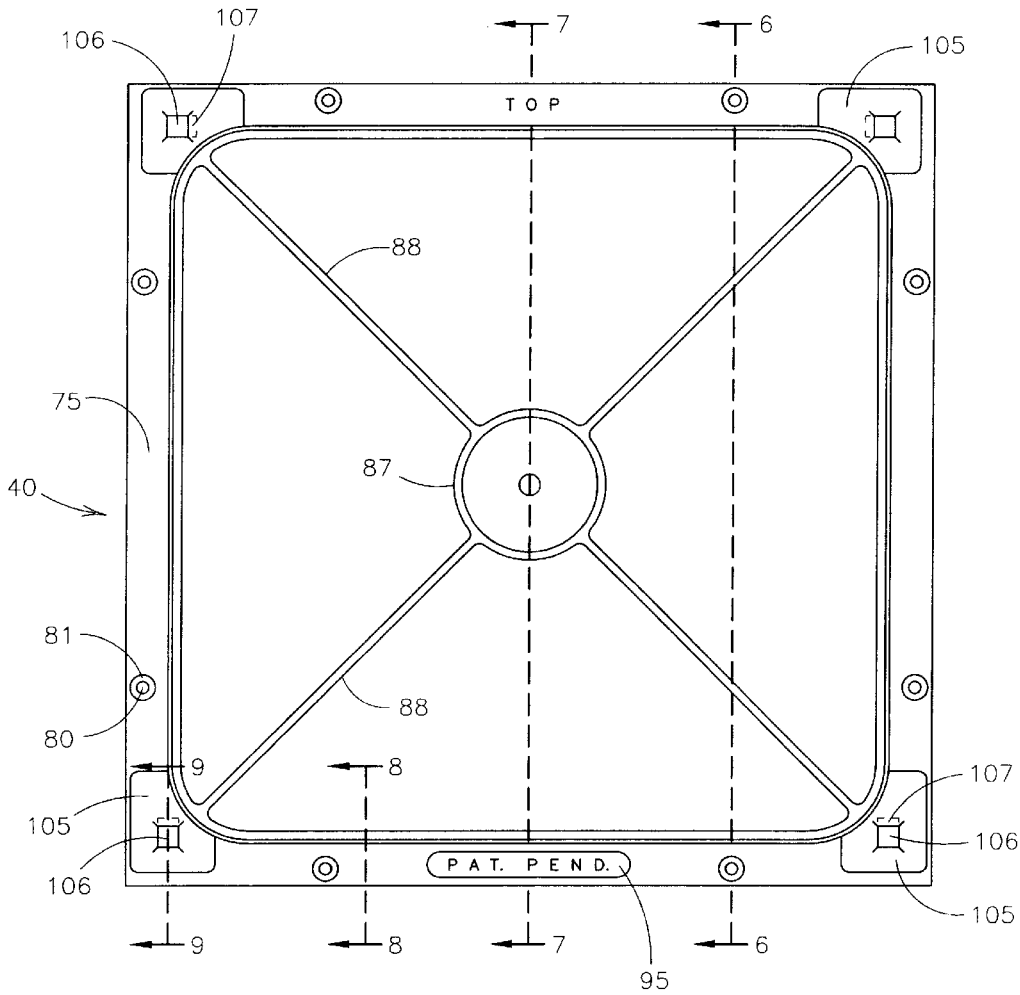
FIG. 5 is a top plan view of the box assembly with the face plate omitted for clarity.
Figure 6:
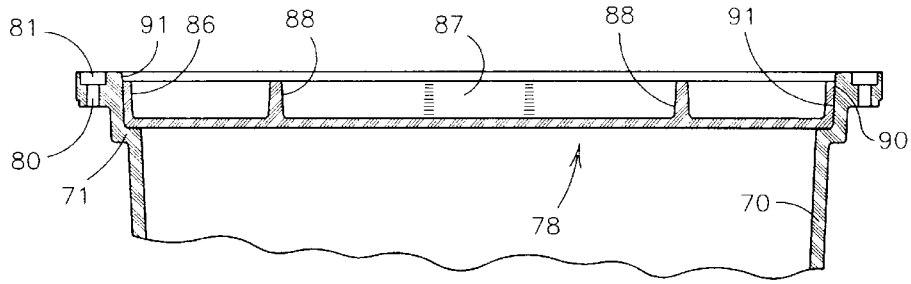
FIG. 6 is a section view taken substantially along the line 6—6 of FIG. 5 with the lower portion of the box broken away.

Referring now to FIGS. 3, 5, 6 and 11 it will be seen, from FIGS. 3, 6 and 11 particularly, that eight bosses 79 are formed on the underside (as viewed in FIG. 11) of the upper flange 74. Each of the bosses has an aperture 80, see FIGS. 3 and 6, and a countersink 81. By reference to FIG. 3 it will be seen that the niche 43 is rigidly anchored to the T-divider 25, and hence the support means for the niche (including vertical upright 62) by a fastener 82, here a wood screw whose head is beneath the sealing surface 75 of the upper flange 74.

Figure 12:
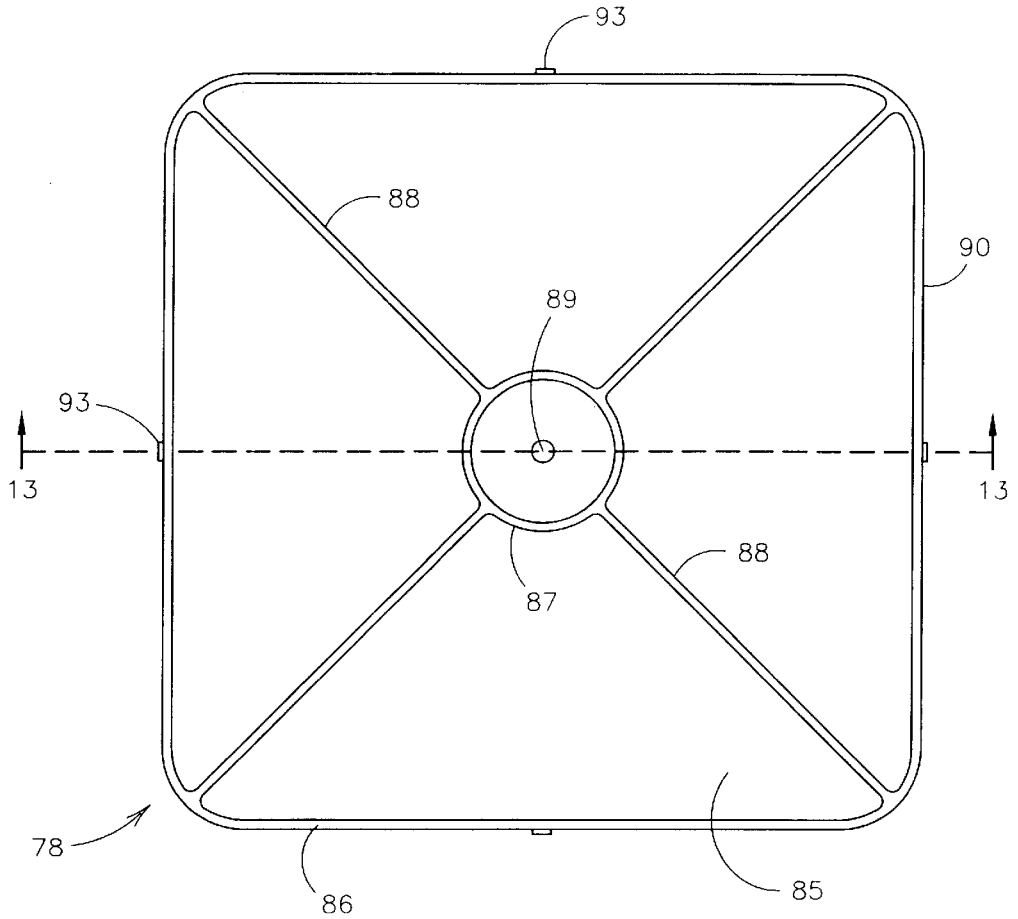
FIG. 12 is a top plan view of the cover of the box assembly.
Figure 13:
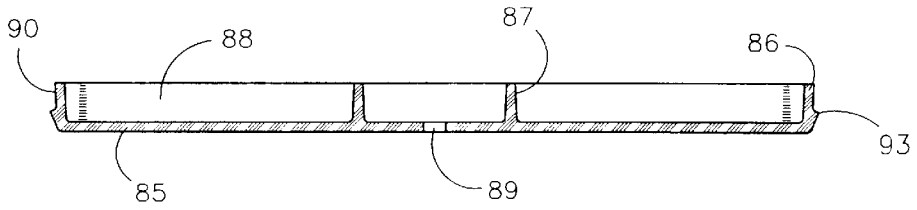
FIG. 13 is a sectional view taken substantially along line 13—13 of FIG. 12.

The cover 78 is illustrated best in FIGS. 3, 5–8, 12 and 13. Referring initially to FIGS. 12 and 13 the cover 78 is seen to consist of a flat plate 85 with four rounded comers. An edge wall 86 extends outwardly for a short distance about the periphery of flat plate 85 as best seen in FIGS. 3, 6–8 and 13. A central, circular reinforcement web collar is indicated at 87 and four reinforcement webs 88 extend outwardly from the collar to provide structural rigidity to the cover. An air exhaust aperture is shown at 89 for reception of a conventional valve, preferably a needle valve, for the purpose of drawing a vacuum within the niche assembly after remains have been placed in the niche 43 and the cover 78 sealed to the niche 43 by the use of a sealing adhesive between the exterior surface 90, see FIGS. 3, 12 and 13, of the wall 86 and the interior surface 91, see FIGS. 3 and 6, of the annular collar portion 73 of the niche 43.

Cover 78 includes four locking dogs 93, see FIGS. 7, 12 and 13, which project outwardly from edge wall 86 of the cover, each dog 93 being located, in this instance, at the mid-point of the four sides of edge wall 86, see particularly FIG. 12. Each dog 93 fits within a socket 94, see FIGS. 7 and 10, in the annular collar portion 73 of niche 43, one socket 94 being provided at the mid-point of the four sides of the collar portion 73.

An oblong depression 95, see FIGS. 5 and 7, is formed in the outer surface of upper flange 74 to receive identifying indicia.

Figure 14:
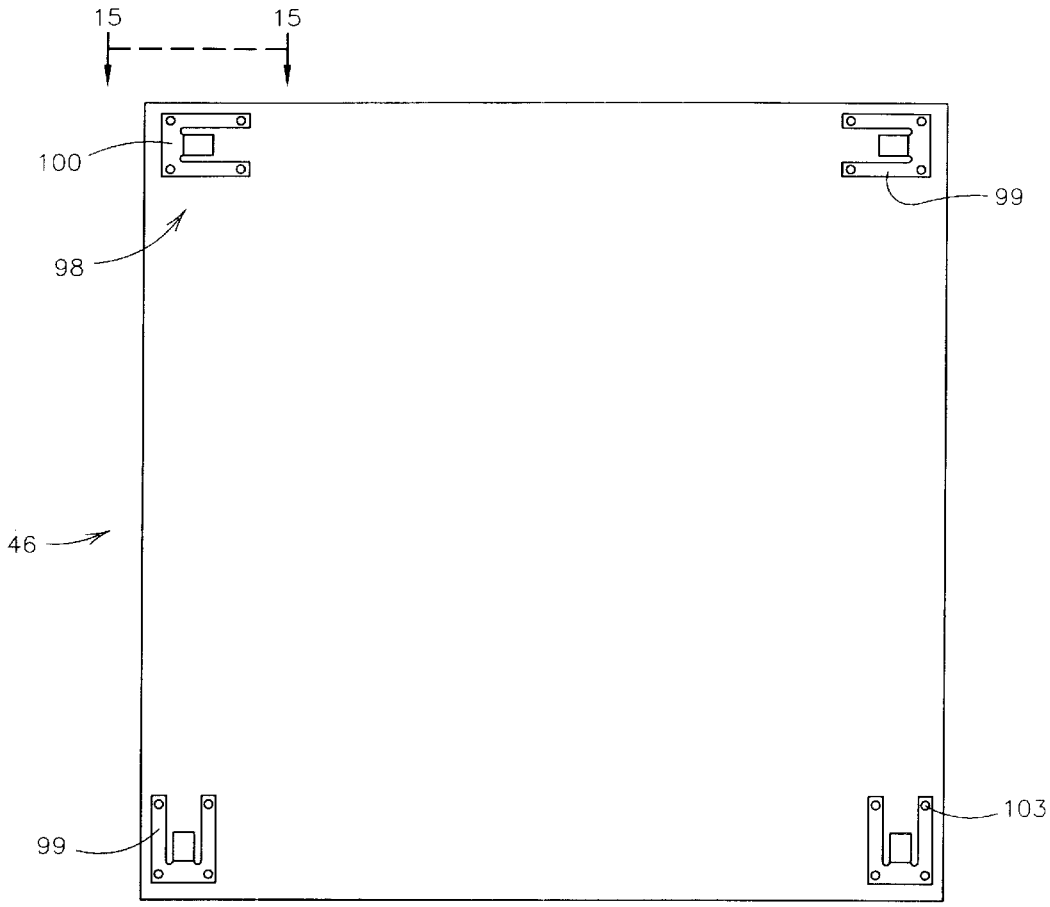
FIG. 14 is a view of the underside of the face plate prior to its connection to the box assembly.
Figure 15:
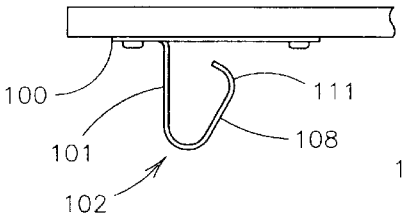
FIG. 15 is a side view to an enlarged scale of a portion of the face plate of FIG. 14 showing particularly one of the connecting clips in side view.
Figure 17:
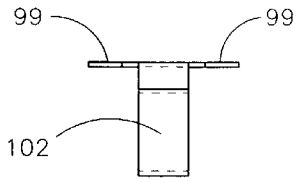
FIG. 17 is an end view of the clip of FIG. 16.
Figure 16:
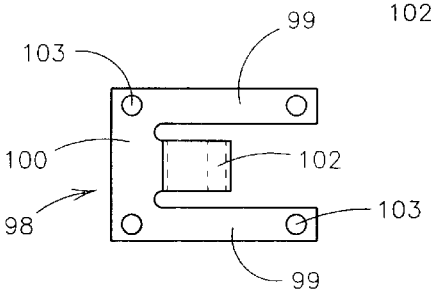
FIG. 16 is a plan view of the clip of FIG. 15 shown in its condition prior to securement to the face plate.

The face plate 46 which provides the viewed surface of the niche unit 12 is shown best in FIGS. 3, 4, 14 and 15. As best seen in FIG. 14, face plate 46 is rectangular in shape and dimensioned to fit snugly in the space defined by an adjacent pair of vertical T- and L-dividers 25–29 and an adjacent pair of front horizontal support channels 57.

The face plate 46 is connected to a niche assembly 40 or 41 by four spring clips indicated generally at 98, see FIGS. 4 and 14–17 particularly. Each spring clip 98 is formed from sheet or strip stock by conventional forming methods and includes a U-shaped base having two legs 99 spaced apart by bight 100. A J-shaped connector 101, see FIG. 15, extends outwardly from the base and includes a resilient depressible hook 102. A spring clip 98 is secured to each corner of the interior side of the face plate 46 by any suitable means, but glue is the preferred means. Four apertures 103 are formed in the legs 99 of the clip, one aperture at each end of each leg. After glue is applied and the clip is pressed against the interior surface of face plate 46, excess glue 104 will ooze into, and sometimes all the way through, the apertures 103, see FIG. 4.

Figure 4:
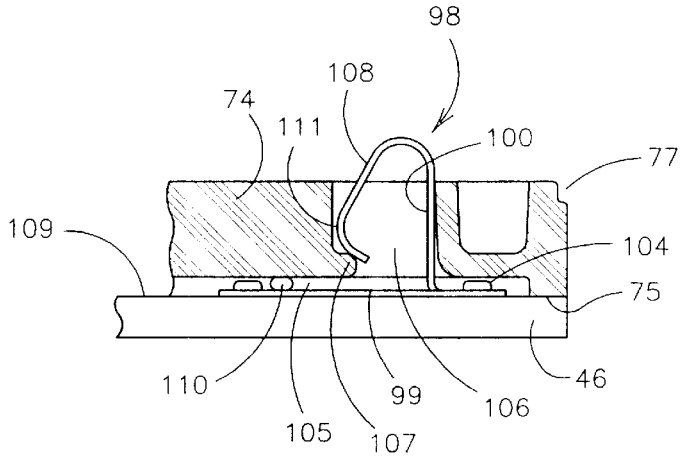
FIG. 4 is a sectional view with parts broken away through the means for mounting a face plate to its associated box.
Figure 9:
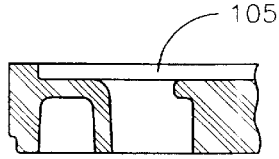
FIG. 9 is a section view taken substantially along the line 9—9 of FIG. 5 to an enlarged scale with the lower portion of the box broken away.
Figure 10:
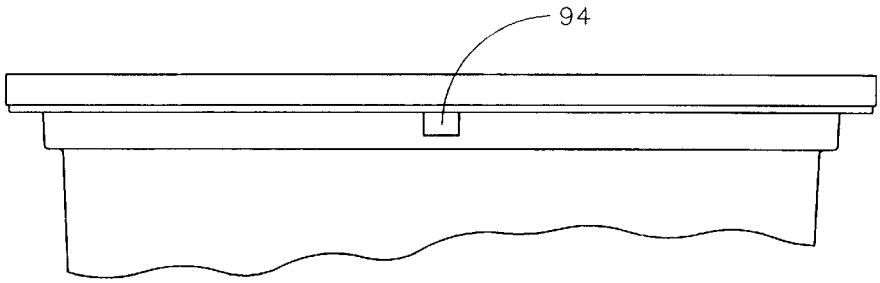
FIG. 10 is a side view of the top portion of the exterior of the box.

Referring now particularly to FIGS. 4, 5, 9 and 14 it will be noted from FIGS. 5 and 9 that a depression 105 is formed in the comers on the sealing surface 75 of the flange 74 of the niche 46. A rectangular shaped aperture 106 is formed in each depression 105 as best seen in FIGS. 5 and 11. Three of the four walls which form each rectangular aperture are smooth and uninterrupted as represented by the right side of the aperture 106 shown in FIG. 4, but one side has a projection 107. When a face plate 46 having clips 98 secured thereto is assembled to a niche assembly, the ramp portion 108 of the clip will slide on projection 107 while in contact with it, and then will snap into the position of FIG. 4 when the interior surface 109 of face plate 46 moves into abutting contact with the flat sealing surface 75 of the niche 43 as seen in FIG. 4.

Suitable sealing material may be placed between sealing surface 75 on the niche assembly and that footprint of the interior surface 109 of niche 43 which makes contact with sealing surface 75. A seal ring 110, which is shown only slightly compressed in FIG. 4 since it passes through the depression 105, represents sealing means generally between the niche assembly and the niche unit, or, alternatively, simply adhesive means in depression 105.

One unique feature of the invention is the easy removeability and reconnection of the face plate 46 to the niche assembly 40 any desired number of times prior to activation, together with a strong mechanical locking action following activation. Thus, by reference to FIGS. 1, 5, 11 and 14, and particularly FIGS. 5 and 14, it will be noted that the longer dimension of the two apertures 106 at the top of FIG. 5 and the major axis of the two clips at the top of FIG. 14 lie in the same direction. By the same token, the longer dimension of the two apertures 106 at the bottom of FIG. 5 and the major axis of the two clips at the bottom of FIG. 14 also lie in the same direction, which direction is 90° offset from the longer dimensions at the top of said Figures. When the face plate 46 of FIG. 14 is assembled to the niche assembly of FIG. 5 in the relationship shown in said Figures, that is, with face plate 46 rotated 180° about its central vertical axis in FIG. 14 to engage the niche assembly 40 of FIG. 5, the strong mechanical locking action illustrated in FIG. 4 will be the result. In the FIG. 4 condition, the face plate 46 is virtually impossible to remove from the niche assembly 40, and thus FIG. 4 represents the activated condition.

However, if the face plate 46 of FIG. 14 is rotated 90° in the plane of the paper prior to being rotated 180° about its central vertical axis, that is, the face plate is re-oriented with respect to the niche assembly, and then assembled to the niche assembly 40 of FIG. 5, no mechanical locking action will occur. Specifically, if the ramp 108 of clip 98 engages either the right wall or the rear wall of aperture 106 in FIG. 4 (that is, if the spring clip 98 is rotated 90° in either direction from its illustrated FIG. 4 position), the ramp portion 108 and nose 111 of the clip 98 will engage one of the three flat walls of aperture 106 and the clip will be compressed to a greater extent than the condition shown in FIG. 4, but no interfering or locking engagement between the clip and the aperture 106 will occur. In other words, when the four spring clips 98 hold a face plate 46 to a niche by means of spring generated pressure between the clips and the apertures 106, the niche unit is in an unactivated condition since it is only necessary to overcome the spring pressure generated between two sliding surfaces to separate the face plate 46 from the balance of the niche assembly, and this may be done repeatedly before placement of a container in the niche. However, when, as just mentioned, the face plate is rotated 180° with respect to a niche to cause the spring clips 98 to form a mechanical locking engagement with the projections 107 of apertures 106, then the niche unit is in an assembled condition which is the condition it takes upon placement of a container holding remains therein.

Thus in a multi-unit columbarium, only a portion of the niche units may be activated; i.e.: contain remains, and yet the exterior appearance of all niche units is identical. Those units which have been activated will be strongly mechanically locked in place to the point where the face plate 46 would have to be destroyed or partially broken away to gain access to the interior. At the same time, those niche units which have not been activated, yet in appearance are identical to the activated units, can be easily disassembled, and reassembled if desired, prior to activation. When activated, the interior space of each niche unit is protected by four seals; i.e., the valve in aperture 89, the sealant between the cover and the niche, the sealant between the face plate 47 and sealing surface 75, and the seal 110. It is believed that this feature is unique in the industry.

Although the invention has been described in detail it will at once be apparent to those skilled in the art that modifications can be made within the spirit and scope of the invention. Accordingly, it is intended that the scope of the invention not be limited by the foregoing exemplary description, but rather only by the scope of the hereafter appended claims when interpreted in light of the relevant prior art.

We claim:

1. A niche unit for a columbarium, said niche unit including a niche assembly consisting of a niche and a cover for the niche, and an exterior facing member, said exterior facing member being connectable to the niche assembly by connecting means which firstly, permits repeated assembly and disassembly of the facing member to the niche assembly prior to activation of the niche unit, and secondly, permanently secures the facing member to the niche assembly upon activation of the niche unit.

2. The niche unit of claim 1 further characterized in that the facing member is a face plate having a planar exposed surface.

3. The niche unit of claim 1 further characterized in that the exterior facing member is assembleable and disassembleable to the niche.

4. The niche unit of claim 1 further characterized in that the means for connecting the facing member to the niche assembly are a plurality of spring clips carried by the facing member, said spring clips being received in apertures in the upper end portions of the niche.

5. The niche unit of claim 1 further characterized by and including mechanical locking means for securing the cover to the niche.

6. A columbarium, said columbarium including, in combination, support means for a plurality of niche units, said support means including front horizontal members for supporting a plurality of horizontally aligned niche units beneath their outer, lower front end portions, and rear horizontal members for supporting said plurality of horizontally aligned niche units from locations at the rear end portions of said niche units above the bottoms thereof, and vertical support members connected to the front and rear horizontal members to form a rigid, self standing support means, and a plurality of niche units connected to the self standing support means.

7. A niche unit for a columbarium, said niche unit including a niche assembly consisting of a niche, a cover for the niche, and means for creating a less than atmospheric pressure within the niche assembly when the niche cover is sealingly secured to the niche, and an exterior facing member, said exterior facing member being connectable to the niche assembly by connecting means which firstly, permits repeated assembly and disassembly of the facing member to the niche assembly prior to activation of the niche unit, and secondly, permanently secures the facing member to the niche assembly upon activation of the niche unit.

8. The niche unit of claim 7 further characterized in that the means for creating a less than atmospheric pressure in the niche assembly is a valve in the niche cover accessible from the outside of the niche assembly in the absence of the facing member.

9. A niche unit for a columbarium, said niche unit including a niche assembly consisting of a niche and a cover for the niche, and an exterior facing member, said exterior facing member being connectable to the niche assembly by connecting means which firstly, permits repeated assembly and disassembly of the facing member to the niche assembly prior to activation of the niche unit, and secondly, permanently secures the facing member to the niche assembly upon activation of the niche unit, the means for connecting the facing member to the niche assembly being a plurality of spring clips carried by the facing member, said spring clips being received in apertures in the outer end portions of the niche, the facing member being engageable with the niche in two relative positions of the facing member and niche, said facing member, when in the first position, enabling the spring clips to be easily assembleable to and disassembleable from the niche, and when in the second position, causing the facing member to be permanently locked to the niche.

10. The niche unit of claim 9 further characterized in that the facing member is rectangular in configuration.

11. The niche unit of claim 10 further characterized in that the facing member is square in configuration.

12. A columbarium, said columbarium including, in combination, support means for a plurality of niche units, said support means including front horizontal members for supporting a plurality of horizontally aligned niche units beneath their outer, lower front end portions, and rear horizontal members for supporting said plurality of horizontally aligned niche units from locations at the rear end portions of the said niche units, and vertical support members connected to the front and rear horizontal members to form a rigid, self standing support means, and a plurality of niche units connected to the self standing support means, characterized firstly, in that each niche unit includes a niche assembly consisting of a niche and cover for the niche, and secondly, in that the closed bottom of the niche has a concave depression therein, said concave depression being arranged to receive an associated rear horizontal member of the support means in snug supporting relationship with the rear of the niche.

13. The columbarium of claim 12 further characterized by and including front vertical members, said front vertical members being part of the niche unit support means, and means for connecting the front portion of each niche unit to the front vertical members in rigid relationship whereby each niche unit is independently secured to the niche unit support means in fixed relationship to said support means and other niche units.

14. The columbarium of claim 13 further characterized in that the niche and niche cover form a niche assembly, and further including an exterior facing member, said exterior facing member being connectable to the niche assembly by connecting means which firstly, permits repeated assembly and disassembly of the facing member to the niche assembly prior to activation of the niche unit, and secondly, permanently secures the facing member to the niche assembly upon activation of the niche unit.

15. A columbarium, said columbarium including in combination, support means for rigidly supporting a plurality of niche units, said support means including front horizontal members for supporting a plurality of horizontally aligned niche units at their outer, lower front portions, rear horizontal members which engage and support each of said plurality of horizontally aligned niche units at the locations at the rear end portions of each of said niche units and between the tops and bottoms of each of said niche units, vertical support members connected to the front horizontal members, only two rear vertical support members connected to the rear horizontal members, one at each end of the plurality of horizontally aligned niche units, which fixedly space the rear horizontal members from one another and form a rigid, self-standing support means, and a plurality of niche, wits connected to the self-standing support means.

16. The columbarium of claim 15 further characterized in that the rear portion of each of the niche units has a depression formed therein which abuttingly contacts an associated rear horizontal member in fixed relationship.

17. The columbarium of claim 16 further characterized in that the depression in each niche unit is generally U-shaped in cross section and is located above the lower portion of the niche unit.

18. In a niche assembly consisting of a niche and a cover for the niche, a facing member for the niche assembly, said facing member being engageable with the niche assembly in two relative positions of the facing member and the niche assembly, said facing member, when in one position, being easily assembleable and disassembleable from the niche assembly and when in another position, causing the facing member to be permanently locked to the niche assembly.

19. The niche assembly of claim 18 further characterized in that the facing member is engageable with the niche.

20. The niche assembly of claim 19 further characterized in that the engagement of the facing member to the niche assembly is by spring clip means.

21. The niche assembly of claim 20 further characterized in that the spring clip means includes a spring clip and a receiving aperture therefor, said spring clip and receiving aperture being assembleable to one another in two different orientations.

22. The niche assembly of claim 21 further characterized in that the spring clip is carried by the facing member and the receiving aperture is formed in the niche assembly.

23. The niche assembly of claim 22 further characterized in that the niche includes flange means, said receiving aperture being formed in said flange means.

24. In a columbarium system comprising a plurality of niche assemblies and a support structure for said niche assemblies, said niche assemblies forming a columbarium wherein each niche assembly includes a niche, a cover means for said niche, bottom means for said niche opposite said cover means, said bottom means having a concave depression adapted, when seated in a fixed, elongated horizontal support member of the support structure to support the bottom means in a vertical orientation.

25. The niche of claim 24 further characterized in that said bottom means includes two concave depressions, said concave depressions being located substantially perpendicular to one another each of said concave depressions being adapted to be assembled to a support member whereby said niche can be assembled in two different positions with respect to the fixed support member.

26. The niche of claim 25 further characterized in that the concave depressions are molded into the bottom means of the niche.

* * * * *